US009765793B2

(12) United States Patent
Cocks et al.

(10) Patent No.: US 9,765,793 B2
(45) Date of Patent: Sep. 19, 2017

(54) FAN IMPELLER BLADE

(71) Applicant: Regal Beloit America, Inc., Beloit, WI (US)

(72) Inventors: Rachele B. Cocks, Columbia City, IN (US); Rafal Pawel Rohoza, Fort Wayne, IN (US)

(73) Assignee: Regal Beloit America, Inc., Beloit, WA (US)

( * ) Notice: Subject to any disclaimer, the term of this patent is extended or adjusted under 35 U.S.C. 154(b) by 502 days.

(21) Appl. No.: 14/318,906

(22) Filed: Jun. 30, 2014

(65) Prior Publication Data

US 2015/0377248 A1 Dec. 31, 2015

(51) Int. Cl.

*F04D 29/28* (2006.01)
*F04D 29/30* (2006.01)
*F04D 17/04* (2006.01)

(52) U.S. Cl.

CPC ..... *F04D 29/283* (2013.01); *F04D 17/04* (2013.01); *F04D 29/30* (2013.01)

(58) Field of Classification Search

CPC ..... F04D 29/283; F04D 29/30; F04D 17/04; F01D 5/14; B64C 23/06; B64C 23/065; B64C 21/10

See application file for complete search history.

(56) References Cited

U.S. PATENT DOCUMENTS

| | | | | |
|---|---|---|---|---|
| 3,578,264 | A * | 5/1971 | Kuethe | B64C 21/10 181/220 |
| 4,822,249 | A * | 4/1989 | Eckardt | F01D 5/145 416/235 |
| 7,070,850 | B2 * | 7/2006 | Dietz | B32B 27/08 244/130 |
| 7,900,871 | B2 | 3/2011 | Rincker et al. | |
| 8,057,185 | B2 | 11/2011 | Brendel | |
| 8,197,181 | B2 * | 6/2012 | Park | F04D 29/666 415/53.1 |
| 2010/0090496 | A1 | 4/2010 | Carlson | |
| 2011/0006165 | A1 | 1/2011 | Ireland | |
| 2012/0201680 | A1 | 8/2012 | Hall et al. | |
| 2014/0301825 | A1 * | 10/2014 | Tian | F04D 29/30 415/53.1 |

* cited by examiner

*Primary Examiner* — Dwayne J White
*Assistant Examiner* — Peter T Hrubiec
(74) *Attorney, Agent, or Firm* — Armstrong Teasdale LLP

(57) ABSTRACT

A centrifugal fan impeller includes a front endring, a rear endring, and a plurality of blades coupled between the front and the rear endrings. At least one blade of the plurality of blades includes a blade span extending between the front endring and the rear endring, a leading edge, and a trailing edge. The at least one blade further includes a first elliptical cross-sectional profile extending between the leading and the trailing edges.

14 Claims, 5 Drawing Sheets

FAN IMPELLER BLADE

BACKGROUND

The field of the disclosure relates generally to centrifugal fans and, more specifically, to fan impellers with blades having an elliptical cross-section.

Fan impellers, such as centrifugal fan impellers, are used in a wide variety of applications. Many of these applications utilize a centrifugal impeller with a forward curved blade design, often referred to as a forward curved fan. A forward curved fan wheel has the advantage of being relatively compact in size for the amount of air that it can move. In contrast, a centrifugal fan wheel with backward curved blades is typically larger and must turn at a greater speed, than a comparable forward curved fan. It is for this reason that forward curved fans are used in many residential, commercial, industrial, and automotive applications.

However, a typical forward curved fan includes blade designs that provide stable and efficient airflow over a relatively narrow operating range. More specifically, at least some known forward curved fan impellers include blades whose cross-section is formed from a single radius, also known as a circular blade design. Furthermore, at least some known forward curved fan impellers include blades whose cross-sectional profile is formed by a combination of two or more unrelated radii such that an inner portion of the blade has a first radii and an outer portion of the blade has a second radii. A transition point is defined where the first radii shifts to the second radii.

Such blade profiles are known to cause separation of the airflow boundary layer from the blade at a point which decreases the efficiency of the impeller. More specifically, the boundary layer is defined between the blade's surface and a point above the surface of the blade where the air is undisturbed. Depending on the profile of the blade, the air will often flow smoothly in a thin boundary layer across the blade's surface. As air flows within the boundary layer, the momentum of the boundary layer flow slows over the length of the blade. A separation point is defined along the blade where the boundary layer separates from the blade and forms a turbulent flow. Boundary layer separation causes adverse pressure gradients in the wake behind the separation point, which decrease the efficiency of the blade. As such, it is advantageous for the boundary layer to remain attached to the blade along as long of a length as possible. However, known circular and combination blade profiles have constant rates of curvature that cause premature boundary layer separation and, therefore, decrease the blade's efficiency.

BRIEF DESCRIPTION

In one aspect, a fan impeller is provided. The centrifugal fan impeller includes a front endring, a rear endring, and a plurality of blades coupled between the front endring and the rear endring. At least one blade of the plurality of blades includes a blade span extending between the front endring and the rear endring, a leading edge, and a trailing edge. The at least one blade further includes a first elliptical cross-sectional profile extending between the leading edge and the trailing edge.

In another aspect, a fan blade is provided. The fan blade includes a blade span, a leading edge, a trailing edge, and a first elliptical cross-sectional profile extending between the leading and the trailing edges.

In yet another aspect, a fan blade is provided. The fan blade includes an arcuate profile defining a chord length, a suction side, and a pressure side. The fan blade also includes a boundary layer trip device coupled to at least one of the suction side and the pressure side. The boundary layer trip device is configured to maintain attachment of a boundary layer to a respective suction side or pressure side.

Although specific features of various embodiments may be shown in some drawings and not in others, this is for convenience only. Any feature of any drawing may be referenced and/or claimed in combination with any feature of any other drawing.

DETAILED DESCRIPTION

Figure 1:
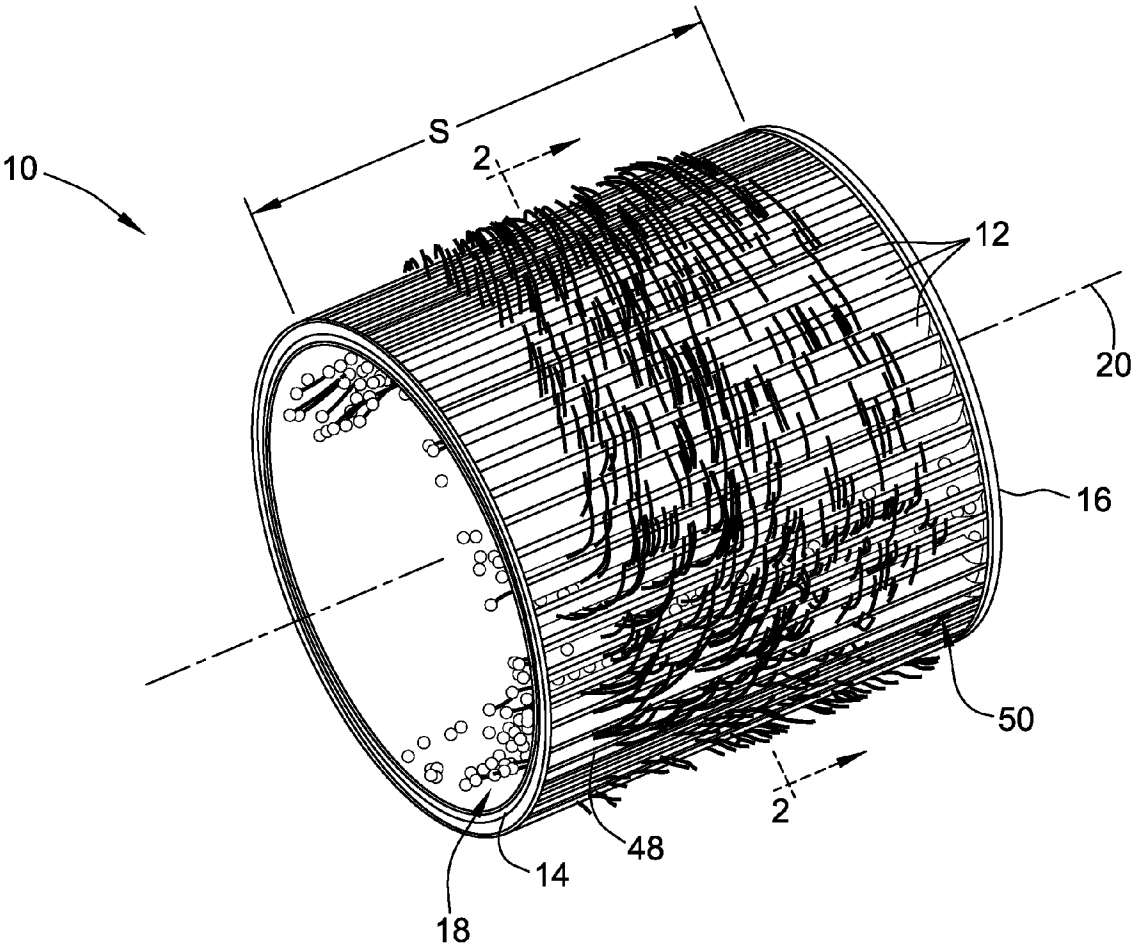
FIG. 1 is a schematic perspective of an exemplary centrifugal fan impeller including a plurality of blades.

FIG. 1 is a schematic perspective view of an exemplary centrifugal fan impeller 10 including a plurality of fan blades 12 each having an elliptical cross-section. In the exemplary embodiment, blades 12 are coupled between a front endring 14 and a rear endring 16 such that a blade span S is defined therebetween. Blades 12 are oriented such that fan impeller 10 is a forward curved fan. Alternatively, fan impeller 10 may be a backward curved fan or any fan type that facilitates operation as described herein. Front endring 14 includes a central air inlet 18. Endrings 14 and 16 are coaxial or substantially coaxial with a center axis 20. Blades 12 are attached to rear endring 16 and/or front endring 14 such that a longitudinal axis of blades 12 is substantially parallel to center axis 20. Blades 12 are configured to pull in air along center axis 20 and eject the air radially outward when rotated about center axis 20 together with rear endring 16 and front endring 14. Blades 12 may be attached to rear endring 16 and/or front endring 14 in any manner that permits fan impeller 10 to operate as described herein. In operation, a motor (not shown) is configured to rotate fan impeller 10 about center axis 20 in a direction indicated in FIG. 1 to produce a flow of air for a forced air system, e.g., a residential or commercial HVAC system.

Figure 2:
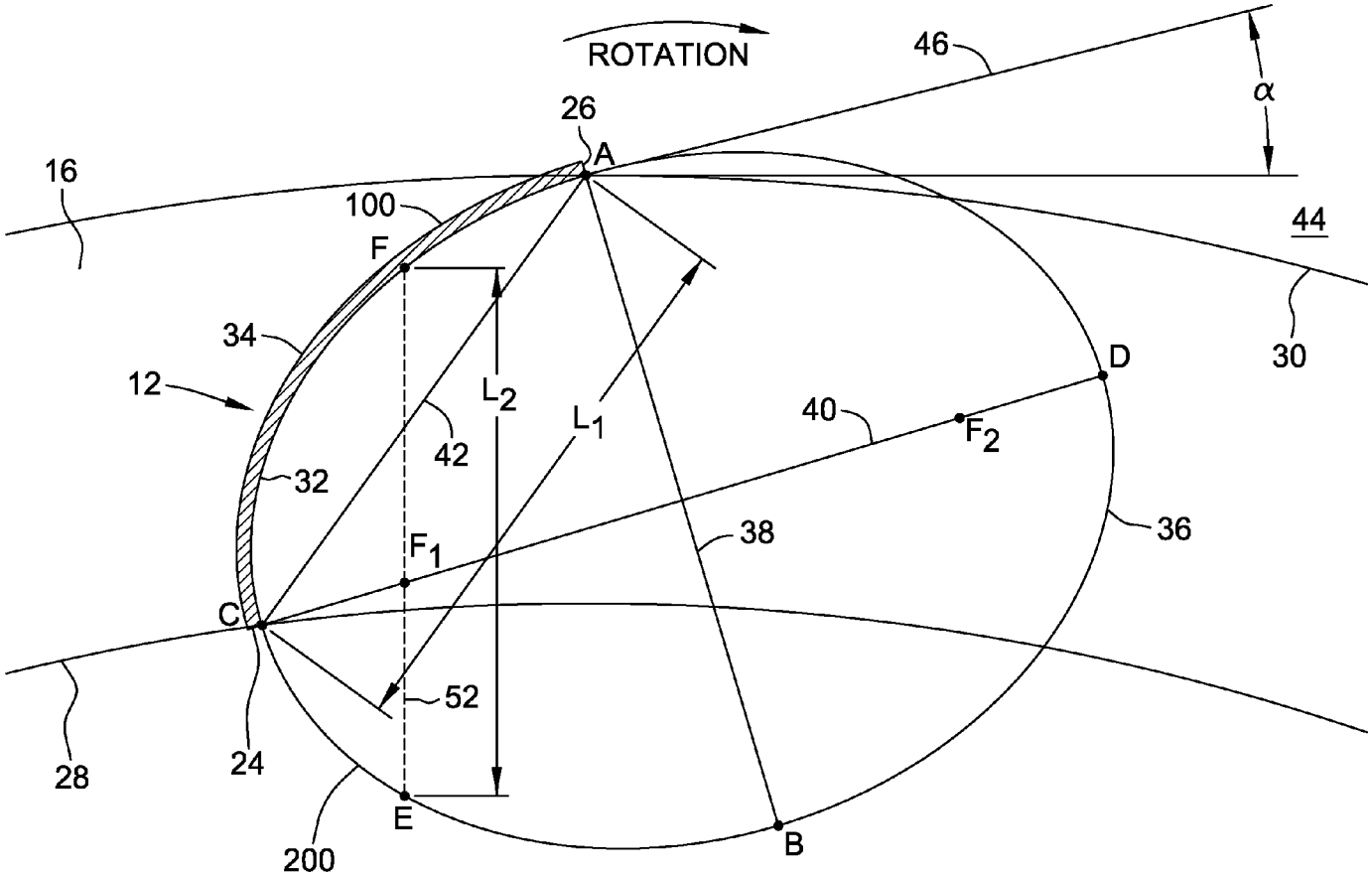
FIG. 2 is a cross-section of the exemplary fan blade shown in FIG. 1 having an elliptical profile.

FIG. 2 is a cross-section of blade 12 having an exemplary elliptical cross-sectional profile 100. Blade 12 may be suitably fabricated from any number of materials, including, but not limited to, a plastic or other flexible or compliant material. For example, blade 12 may be formed by a molding, forming, extruding, or three-dimensional printing process used for fabricating parts from thermoplastic or thermosetting plastic materials and/or metals. Alternatively, blade 12 may be fabricated from a combination of materials such as attaching a flexible or compliant material to a rigid material. Blade 12, however, may be constructed of any suitable material, such as metal, that permits blade 12 to operate as described herein.

In the exemplary embodiment, blade 12 includes a leading edge 24 and a trailing edge 26. Leading edge 24 is positioned proximate an inner diameter 28 of rear endring 16 and trailing edge 26 is positioned proximate an outer diameter 30 of rear endring 16. Alternatively, edges 24 and 26 may not be collinear with diameters 28 and 30, respectively, along span S. Blade 12 also includes a pressure face 32 and a suction face 34 that each extend between leading and trailing edges 24 and 26. As illustrated in FIG. 2, a cross section of blade 12 has an elliptical profile 100, i.e., the elliptical shape of blade 12 has a constantly changing rate of curvature such that blade profile 100 is not defined by a constant radius or by a combination of two or more unrelated radii. More specifically, blade profile 100 is a portion of an ellipse 36 defined by a first focus F1 and a second focus F2. Ellipse 36 includes vertices A and B, where the curvature of ellipse 36 is at a minimum, and vertices C and D, where the curvature of ellipse 36 is at a maximum. A minor axis 38 is defined between vertices A and B, and a major axis 40 is defined between vertices C and D.

In the exemplary embodiment, leading edge 24 is positioned at vertex C and trailing edge 26 is positioned at vertex A such that a blade chord 42 is defined therebetween. As described above, vertex C is located at a point of the largest rate of curvature of ellipse 36. As such, blade 12 has the largest rate of curvature at leading edge 24. Similarly, vertex A is located at a point of the smallest rate of curvature of ellipse 36 such that blade 12 has the smallest rate of curvature at leading edge 24. As such, blade 12 defines blade profile 100 having a continuously changing curvature from leading edge 24 to trailing edge 26.

In the exemplary embodiment, when fan impeller 10 is in operation, air enters through central air inlet 18 and is deflected radially outward from central axis 20 of fan impeller 10 towards blade 12. Blade 12 is configured to pull the air from central air inlet 18. The air passes through channels (not shown) between adjacent blades 12 and is forced outwards due to the centrifugal force generated by rotating blades 12. More specifically, the high rate of curvature of leading edge 24 of each blade 12 quickly changes the direction of airflow such that the air travels along blade 12 and is released at an exit angle $\alpha$ defined between a plane 44 tangent to ellipse 36 at trailing edge 26 and a trailing edge extension plane 46. In the exemplary embodiment, trailing edge extension plane 46 is substantially parallel to major axis 40 because trailing edge 26 overlies vertex A, which causes the airflow to exit blade 12 at an optimal exit angle $\alpha$ to provide for a laminar flow when the air is released. The continuously changing curvature of blade 12 creates a turbulent boundary layer that maintains airflow attachment along substantially an entirety of blade 12 between edges 24 and 26.

In the exemplary embodiment, blade 12 has a constant cross-sectional profile, such as, but not limited to, profile 100 shown in FIG. 2, along span S between front endring 14 and rear endring 16. Alternatively, blade 12 may have a profile that varies in shape and/or size along span S. In such embodiments, profile 100 remains elliptical, but may be different in size and/or shape. More specifically, in one alternative embodiment, blade 12 has profile 100 at a first point along span S, such as at point 48 (shown in FIG. 1), proximate front endring 14 and has a second profile 200 at a second point along span S, such as at point 50 (shown in FIG. 1), proximate rear endring 16. Although points 48 and 50 are shown proximate endrings 14 and 16, respectively, points 48 and 50 may be located anywhere along span S that facilitates operation of impeller 10. Similar to profile 100, profile 200 is a portion of ellipse 36. Profile 200 is the portion of ellipse 36 defined between points E and F on a circumference of ellipse 36 and includes a chord 52 having a length L2 that is different from length L1 of chord 42 of profile 100. As such, blade 12 may have a chord length that changes along span S. Although profile 200, as shown in FIG. 2, partially overlaps profile 100, profile 200 may be any portion of ellipse 36 and does not necessarily overlap any portion of profile 100.

Figure 3:
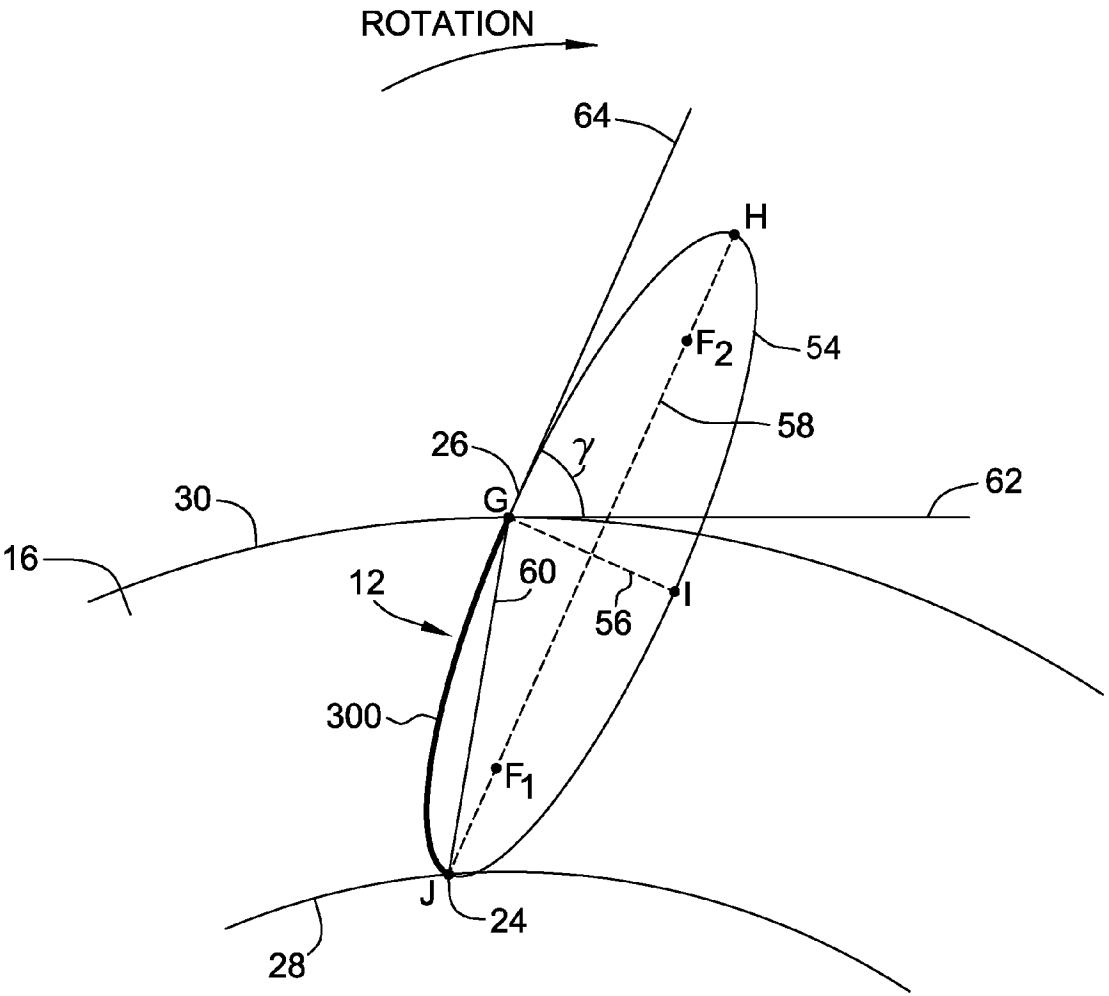
FIG. 3 is a cross-section of the exemplary fan blade shown in FIG. 1 having an alternative elliptical profile.

FIG. 3 shows an alternative embodiment of blade 12 having a third elliptical profile 300. Blade profile 300 is a portion of an ellipse 54 defined by a first focus F1 and a second focus F2. Ellipse 54 includes vertices G and I, where the curvature of ellipse 54 is at a minimum, and vertices H and J, where the curvature of ellipse 54 is at a maximum. A minor axis 56 is defined between vertices G and I, and a major axis 58 is defined between vertices H and J.

Similar to profile 100, leading edge 24 is positioned at vertex G and trailing edge 26 is positioned at vertex J such that a blade chord 60 is defined therebetween. As described above, vertex J is located at a point of the largest rate of curvature of ellipse 54. As such, profile 300 has the largest rate of curvature at leading edge 24. Similarly, vertex G is located at a point of the smallest rate of curvature of ellipse 54 such that profile 300 has the smallest rate of curvature at leading edge 24. As such, blade 12 defines blade profile 300 having a continuously changing curvature from leading edge 24 to trailing edge 26. Blade 12 having profile 300 releases the airflow at an exit angle $\gamma$ defined between a plane 62 tangent to ellipse 54 at trailing edge 26 and a trailing edge extension plane 64.

As described above, blade 12 may have an elliptical profile that changes along span S. For example, in one embodiment, blade 12 has profile 100 at point 48 (shown in FIG. 1) of impeller 10 and has profile 300 at point 50 (shown in FIG. 1) of impeller 10. In such an embodiment, profile 100 releases the airflow at exit angle $\alpha$ and profile 300 releases the airflow at exit angle $\gamma$ such that blade 12 releases the airflow at different exit angles along span S. Profile 100 is a portion of ellipse 36 and profile 300 is a portion of ellipse 54 such that blade 12 may include profiles 100 and 200 of different ellipses 36 and 54 along span S.

In the exemplary embodiment, the continuously changing rate of curvature of blade 12 is configured to maintain boundary layer attachment to suction side 34 of blade 12 to increase the efficiency of blade 12 and impeller 10. More specifically, the continuously changing elliptical profile of blade 12 is configured to maintain boundary layer attachment along suction side 34 to trailing edge 26. Maintaining the boundary layer to a point as close as possible to trailing edge 26 ensures that the airflow along suction side 34 is released as a laminar flow, which improves impeller 10 efficiency and reduces noise levels.

Figure 4:
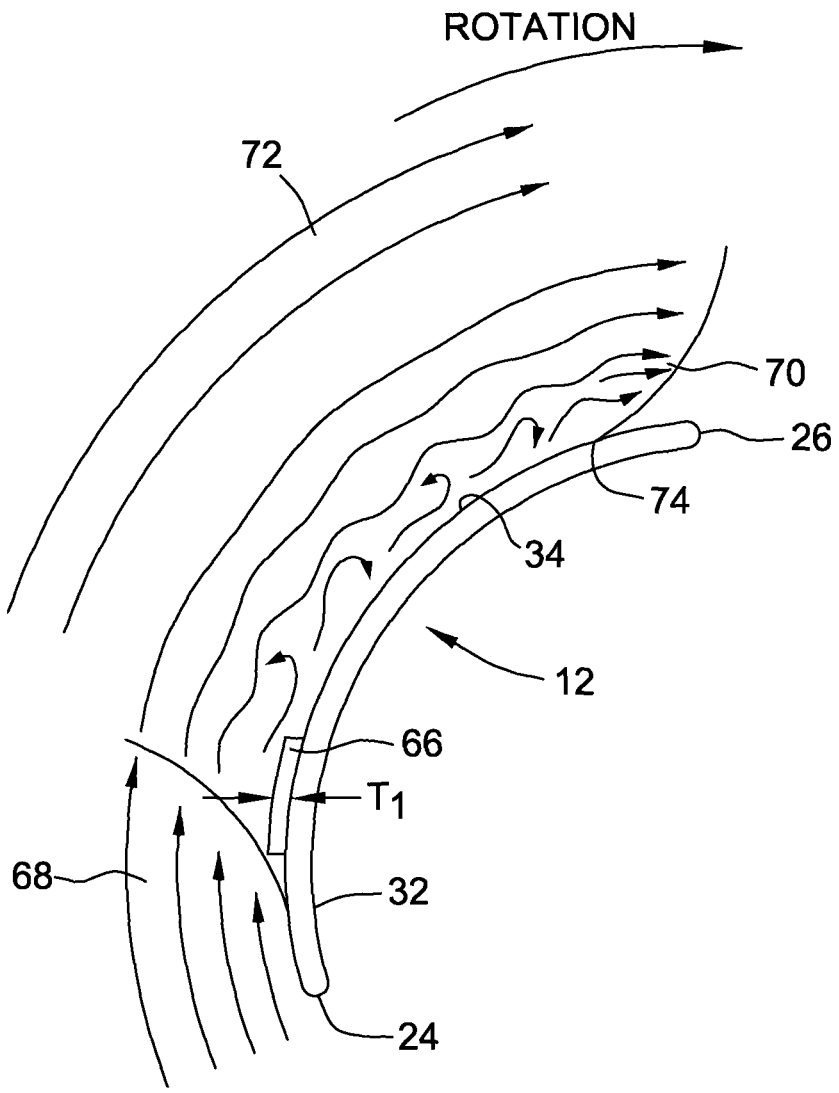
FIG. 4 is a cross-section of the exemplary fan blade shown in FIG. 2 having a boundary layer trip device coupled thereto.

FIG. 4 is a cross-sectional view of blade 12 having a boundary layer trip device (BLTD) 66 coupled thereto. In the exemplary embodiment, BLTD 66 is configured to disrupt the boundary layer over blade 12 to create a transition from a laminar boundary layer 68 upstream of BLTD 66 to a turbulent boundary layer 70 downstream of BLTD 66. Although shown as used in combination with blade 12, BLTD 66 may be used with any shaped blade and is not limited to use with blade 12 having an elliptical profile. As described above, boundary layers 68 and 70 are defined between suction side 34 of blade 12 and an undisturbed laminar flow 72 above suction side 34. A separation point 74 is defined along blade 12 where boundary layer 70 separates from suction side 34 and forms a turbulent flow. Boundary layer separation causes adverse pressure gradients in the wake behind separation point 74, which decreases the efficiency of blade 12. As such, it is advantageous for separation point 74 to be as near as possible to trailing edge 26 such that boundary layer 70 remains attached to blade 12 as long as possible.

Figure 5:
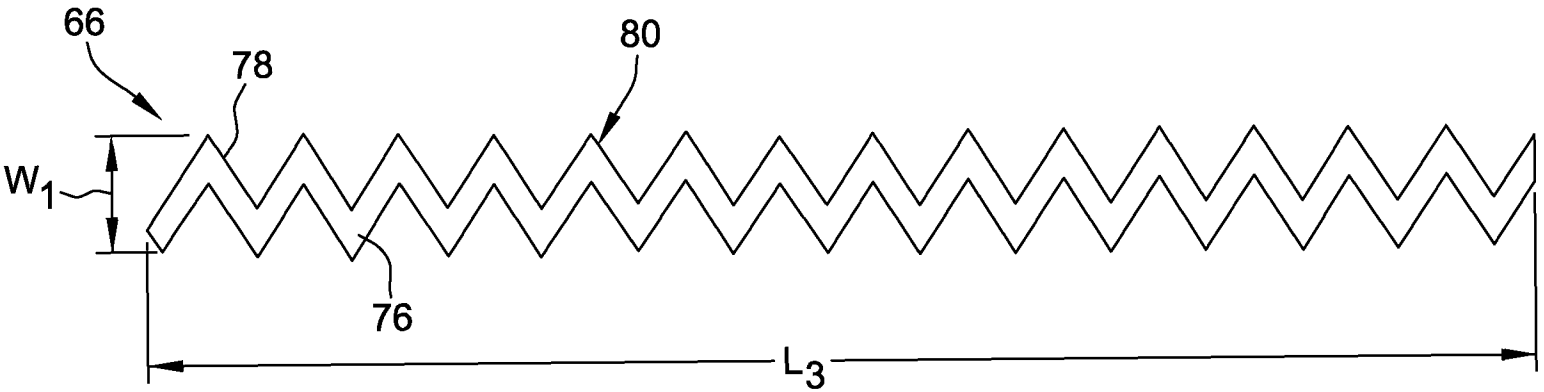
FIG. 5 is a top view of the boundary layer trip device shown in FIG. 4.

FIG. 5 illustrates BLTD 66 used to form turbulent boundary layer 70. In the exemplary embodiment, BLTD 66 is an adhesive tape that is coupled to at least one of suction side 34 and pressure side 32 of blade 12 with a high shear strength adhesive. Alternatively, BLTD 66 may include a plurality of dimples, ridges, and/or openings formed in blade 12, and/or a three-dimensional vortex generator (not shown) that extends obliquely from suction side 34. Generally, BLTD 66 may be any device, coupled to blade 12 or formed integrally therewith, that trips laminar boundary layer 68 upstream of BLTD 66 to form turbulent boundary layer 70 downstream of BLTD 66.

In the exemplary embodiment, BLTD 66 includes a leading edge 76 and a trailing edge 78. Both leading edge 76 and trailing edge 78 include a plurality of V-shapes 80 such that BLTD 66 forms a zig-zag pattern. Alternatively, only one of leading edge 76 and trailing edge 78 is V-shaped. Furthermore, at least one of leading and trailing edges 76 and 78 may be straight edge that is substantially parallel to leading and trailing edges 24 and 26, respectively, of blade 12. BLTD 66 includes a length L1 that is substantially similar to span S of blade 12 such that BLTD extends substantially entirely between front endring 14 and rear endring 16 (both shown in FIG. 1). Alternatively, length L3 of BLTD 66 may be less than span S. Furthermore, BLTD 66 includes a thickness T1 (shown in FIG. 4) that is determined based on varying local boundary layer characteristics, such as, but not limited to, boundary layer height. In the exemplary embodiment, thickness T1 is within a range of approximately 1.0% of the local boundary layer height to multiple times the local boundary layer height, for example, without limitation, 5 to 10 times the local boundary layer height. More specifically, the greater the thickness the boundary layer 68 between suction side 34 and laminar flow 72, the greater the thickness T1 of BLTD 66. Generally, thickness T1 is less than half of a thickness (not shown) of boundary layers 68 and 70. One advantage of the present disclosure is the customization to the varying local boundary layer with tailored and varying thicknesses T1 of BLTD 66. Furthermore, BLTD 66 also includes a width W1 that is in a range of approximately 10.0% to approximately 40.0% the length L1 of blade chord 42. More specifically, width W1 is within a range of approximately 15.0% to approximately 25.0% the length L1 of chord 42. Generally, the longer the width W1 of BLTD 66, the further separation point 74 is located along blade 12. Alternatively, the thickness and the width of BLTD 66 can be customized based on specific airflow characteristics at specific locations along blade 12 to facilitate operation of impeller 10 as described herein.

In the exemplary embodiment, BLTD 66 is located on suction side 34 at a point that is based on both a height of boundary layer 68 and the thickness T1 of BLTD 66. As mentioned above, as the thickness of boundary layer 68 increases toward trailing edge 26, thickness T1 of BLTD 66 also increases. Accordingly, when BLTD 66 and boundary layer 68 are relatively thin, such as on the leading edge half of blade 12, BLTD 66 is positioned closer to leading edge 24. Similarly, when BLTD 66 and boundary layer 68 are relatively thick, such as on the trailing edge half of blade 12, BLTD 66 is positioned closer to trailing edge 26. The placement is such that BLTD 66 facilitates tripping laminar boundary layer 68 into turbulent boundary layer 70, where boundary layers 68 and 70 have the same thickness.

In the exemplary embodiment, BLTD 66 between leading edge 24 and a point that is approximately 50.0% the length L1 of chord 42 from leading edge 24. More specifically, BLTD 66 is positioned within a range of approximately 5.0% to approximately 25.0% the length L1 of chord 42 from leading edge 24. In embodiments having BLTD 66 on pressure side 32, BLTD 66 is positioned within a range of approximately 50.0% to approximately 100.0% the length L1 of chord 42 from leading edge 24. More specifically, BLTD 66 is positioned on pressure side 32 within a range of approximately 60.0% to approximately 75.0% the length L1 of chord 42 from leading edge 24. Alternatively, the location of BLTD 66 can be customized and particularly placed anywhere along blade 12 based on specific airflow characteristics at specific locations along blade 12 to facilitate operation of impeller 10 as described herein.

The apparatus described herein provide a centrifugal fan impeller having increased efficiency, reduced noise, and an improved airflow distribution at the blower outlet opening. One advantage to the elliptical blade profile is that the continuously changing rate of curvature cause the boundary layer to remain attached to the surface of the blade for a longer duration as compared to blades having a constant rate of curvature or blades having a combination of two or more curvatures. The longer the boundary layer is attached to the blade, the more efficient the blade because premature separation of the boundary layer causes adverse pressure gradients in the wake downstream of the separation point. Such adverse pressure gradients increase drag and decrease efficiency. Another advantage described herein is the boundary layer trip device that is configured to trip a laminar boundary layer into a turbulent boundary layer. A turbulent boundary layer contains more energy and will delay separation until a greater magnitude of adverse pressure gradient is reached, effectively moving the separation point further toward the trailing edge on the blade and possibly eliminating separation completely. The elliptical blade profile and boundary layer trip device may be used in combination with each other or may be used independently as each with increase the efficient of the fan impeller.

Exemplary embodiments of the centrifugal blower are described above in detail. The centrifugal blower and its components are not limited to the specific embodiments described herein, but rather, components of the systems may be utilized independently and separately from other components described herein. For example, the components may also be used in combination with other machine systems, methods, and apparatuses, and are not limited to practice with only the systems and apparatus as described herein. Rather, the exemplary embodiments can be implemented and utilized in connection with many other applications.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the invention, including the best mode, and to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A centrifugal fan impeller comprising:

a front endring;

a rear endring; and a plurality of blades coupled between said front endring and said rear endring, at least one of said plurality of blades comprising:

a blade span extending between said front endring and said rear endring;

a leading edge;

a trailing edge;

a first elliptical cross-sectional profile extending between said leading edge and said trailing edge at a first point along said blade span; and a second elliptical cross-sectional profile at a second point along said blade span, wherein said first elliptical cross-sectional profile is a first portion of an ellipse and said second elliptical cross-sectional profile is a second portion of the ellipse that is different from the ellipse first portion.

2. The centrifugal fan impeller in accordance with claim 1, wherein said first elliptical cross-sectional profile is constant along said blade span.

3. The centrifugal fan impeller in accordance with claim 1, wherein said first elliptical cross-sectional profile defines a first exit angle and said second elliptical cross-sectional profile defines a second exit angle different than the first exit angle.

4. The centrifugal fan impeller in accordance with claim 1, wherein said first elliptical cross-sectional profile defines an airflow exit angle that changes along said blade span.

5. The centrifugal fan impeller in accordance with claim 1, wherein said leading edge and said trailing edge are aligned with vertices of an ellipse that define said first elliptical cross-sectional profile.

6. A fan blade comprising:

a blade span;

a leading edge;

a trailing edge;

a first elliptical cross-sectional profile extending between said leading and said trailing edge at a first point along said blade span, wherein said first elliptical cross-sectional profile is a portion of an ellipse defined by a first focus and a second focus; and a second elliptical cross-sectional profile positioned at a second point along said blade span, wherein said first elliptical cross-sectional profile is a first portion of an ellipse and said second elliptical cross-sectional profile is a second portion of the ellipse that is different from the first portion.

7. The fan blade in accordance with claim 6, wherein said first elliptical cross-sectional profile is constant along said blade span.

8. The fan blade in accordance with claim 6, wherein said first elliptical cross-sectional profile defines an airflow exit angle that changes along said blade span.

9. The fan blade in accordance with claim 6 further comprising a suction side, a pressure side, and a boundary layer trip device coupled to at least one of said suction side and said pressure side.

10. A fan blade comprising:

a blade span;

a first elliptical cross-sectional profile defining a chord length at a first point along said blade span, wherein said first elliptical cross-sectional profile is a portion of an ellipse defined by a first focus and a second focus;

a second elliptical cross-sectional profile positioned at a second point along said blade span, wherein said first elliptical cross-sectional profile is a first portion of an ellipse and said second elliptical cross-sectional profile is a second portion of the ellipse that is different from the first portion;

a suction side;

a pressure side; and a boundary layer trip device coupled to at least one of said suction side and said pressure side, wherein said boundary layer trip device is configured to maintain attachment of a boundary layer to a respective suction side or pressure side.

11. The fan blade in accordance with claim 10, wherein said boundary layer trip device comprises a leading edge and a trailing edge, wherein at least one of said leading edge and said trailing edge is V-shaped.

12. The fan blade in accordance with claim 10, wherein said boundary layer trip device is selected from the group comprising adhesive tape, a plurality of dimples formed in said fan blade, and a three-dimensional vortex generator.

13. The fan blade in accordance with claim 10, wherein said boundary layer trip device is coupled to at least one of said suction side and said pressure side at a predetermined location based on at least one of a thickness of the boundary layer and a thickness of said boundary layer trip device.

14. The fan blade in accordance with claim 10, wherein said boundary layer trip device includes a thickness based on a thickness of said boundary layer.

* * * * *